US007556527B2

(12) United States Patent
Li et al.

(10) Patent No.: US 7,556,527 B2
(45) Date of Patent: Jul. 7, 2009

(54) ELECTRICAL CONNECTOR ASSEMBLY

(75) Inventors: Hua Li, Kunshan (CN); Xiao-Gao Yang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,206

(22) Filed: Dec. 26, 2007

(65) Prior Publication Data

US 2008/0153335 A1 Jun. 26, 2008

(30) Foreign Application Priority Data

Dec. 26, 2006 (CN) ..... 2006 2 0152313

(51) Int. Cl.
*H01R 13/60* (2006.01)

(52) U.S. Cl. ..... 439/541.5; 439/680; 439/189

(58) Field of Classification Search ..... 439/541.5, 439/189, 510, 680, 79
See application file for complete search history.

(56) References Cited

U.S. PATENT DOCUMENTS 5,641,295 A 6/1997 Koyama
5,697,802 A 12/1997 Kawabe
6,139,336 A 10/2000 Olson
6,368,128 B1 * 4/2002 Backer et al. ..... 439/189
7,226,311 B2 * 6/2007 Sugita ..... 439/541.5
7,338,307 B2 * 3/2008 Zhang et al. ..... 439/326
2001/0029127 A1 * 10/2001 Higuchi ..... 439/541.5
2004/0023553 A1 * 2/2004 Lee ..... 439/541.5

FOREIGN PATENT DOCUMENTS

CN 02282909 9/2003
JP 3019448 U 10/1995

* cited by examiner

*Primary Examiner*—Hien Vu
(74) *Attorney, Agent, or Firm*—Wei Te Chung

(57) ABSTRACT

An electrical connector assembly is provided for electrically connecting at least a pair of stacked memory cards to a printed circuit board. The assembly includes a first insulative housing and a lower insulative housing positioned below the first insulative housing. Each of the two insulative housings has an elongated slot. A metal peg interconnecting the two insulative housings with each other is provided to enhance the intensity of the electrical connector assembly and prevent it from being broken.

11 Claims, 5 Drawing Sheets

ELECTRICAL CONNECTOR ASSEMBLY

BACKGROUND OF THE INVENTION

1. Field of the Invention

This invention generally relates to the art of electrical connectors, and particularly, to an electrical connector assembly for electrically connecting memory cards.

2. Description of the Related Art

Various of function modules are widely used in personal computers, for example, for date-storage, video, sound and so on. Generally, these modules are connected to a printed circuit board (PCB) by an electrical connector mounted on the PCB. Due to the need for high performance in computer systems and other applications, more than one such modules are desired, and corresponding electrical connectors are needed.

For instance, Chinese Patent NO. 02282909 discloses a stacked electrical connector assembly mounted on a PCB for connecting two memory modules. This electrical connector assembly includes an upper connector having a relatively larger height and a lower connector positioned below the upper connector and having a relatively smaller height. The upper connector is fixed on the PCB by a plurality of contacts received therein soldered on the PCB. The upper connector commonly endures a big torque when an upper memory module is being inserted within, and has a trend to incline rearward. Thus the soldering connection between the contacts of upper connector and the PCB may be broken, especially when the electrical connector assembly has a weaker structure.

BRIEF SUMMARY OF THE INVENTION

Accordingly, it is an object of the present invention to provide an electrical connector assembly with a reliable intensity.

Another object of the present invention is to provide an electrical connector assembly having a peg to prevent the electrical connector assembly from being broken.

To achieve the above objects, an electrical connector assembly includes a first insulative housing having a first elongated slot with a first key element therein, a plurality of first terminals received in the first insulative housing, a second insulative housing positioned below the first insulative housing and having a second elongated slot with a second key element therein, a plurality of second terminals received in the second insulative housing, and a peg positioned adjacent to the first key element and the second key element and having ends respectively inserted into the first insulative housing and the second insulative housing.

DETAILED DESCRIPTION OF THE INVENTION

Figure 1:
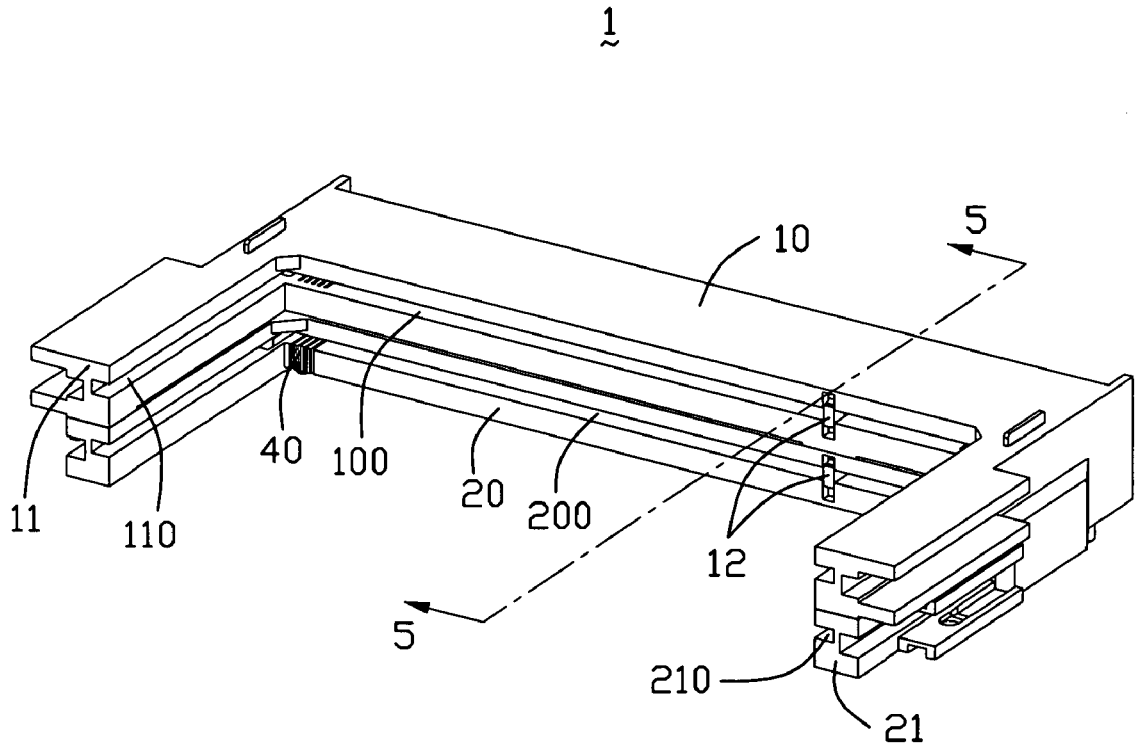
FIG. 1 is an assembled, perspective view of an electrical connector assembly according to an embodiment of the present invention.

FIG. 1 to FIG. 5 illustrates a preferred embodiment of the invention. A electrical connector assembly 1 mounting on a PCB includes a first insulative housing 10 for receiving a upper memory card (not shown) and a second insulative housing 20 positioned below the first insulative housing 10 for receiving a lower memory card (not shown). A plurality of first terminals 30 are received in the first insulative housing 10 and a plurality of second terminals 40 are received in the second insulative housing 20.

Referring to FIG. 1 to FIG. 4, the first insulative housing 10 is formed with an elongated structure with a pair of guiding arms 11 respectively extending forwardly from two ends thereof. An elongated slot 100 is formed in the direction of the length of the first insulative housing 10 for the insertion of a front edge of the upper memory card. Each of the guiding arms 11 has a guiding slot 110 communicating with the elongated slot 100, for guiding the insertion of the upper memory card. A first key element 12 made from metal material is inserted and retained within the elongated slot 100 to divide the elongated slot 100 into two parts with different lengths. A notch (not shown) corresponding to the first key element 12 is formed in the front edge of the upper memory card to prohibit a reverse insertion of the upper memory card. The first insulative housing 10 has a bottom surface 101, a rear wall 102 extending downwardly from the bottom surface 101 and side walls 103, 104 respectively extending forwardly and rearwardly from two ends of the rear wall 102. The bottom surface 101, the rear wall 102 and the side walls 103 together define a receiving space (not labeled) for receiving the second insulative housing 20. A terminal-positioning plate 105 is mounted below the rear wall 102 and between two side walls 104, with a plurality of through holes 1050 therein allowing the first terminals 30 to pass through. A first opening 1010 is formed in the bottom surface 101 and communicating with the elongated slot 100. One end of a metal peg 50 is inserted into the first opening 1010 and engaging with the first key element 12.

The second insulative housing 20 positions below the first insulative housing 10 and is formed with an elongated structure with a pair of guiding arms 21 respectively extending forwardly from two ends thereof. An elongated slot 200 is formed in the direction of the length of the second insulative housing 20 for the insertion of a front edge of the lower memory card. Each of the guiding arms 21 has a guiding slot 210 communicating with the elongated slot 200, for guiding the insertion of the lower memory card. A second key element 12 made from metal material is inserted and retained within the elongated slot 200 to divide the elongated slot 200 into two parts with different lengths. A notch (not shown) corresponding to the second key element 12 is formed in the front edge of the lower memory card to prohibit a reverse insertion of the lower memory card. Two key elements 12 are better than the insulative housings 10, 20 in resistibility of abrasion or breakage. Two key elements 12 are in a line in the vertical direction. The second insulative housing 20 has a top surface 201 facing to the bottom surface 101 of the first insulative housing. An opening 2010 is formed in the top surface 201 and communicating with the elongated slot 200. The other end of metal peg 50 is inserted into the opening 2010 and engaging with the second key element 12. When the first insulative housing 10 and the second insulative housing 20 are assembled together, the first opening 1010 and the second opening 2012 are in a line in the vertical direction and communicate with each other.

Figure 3:
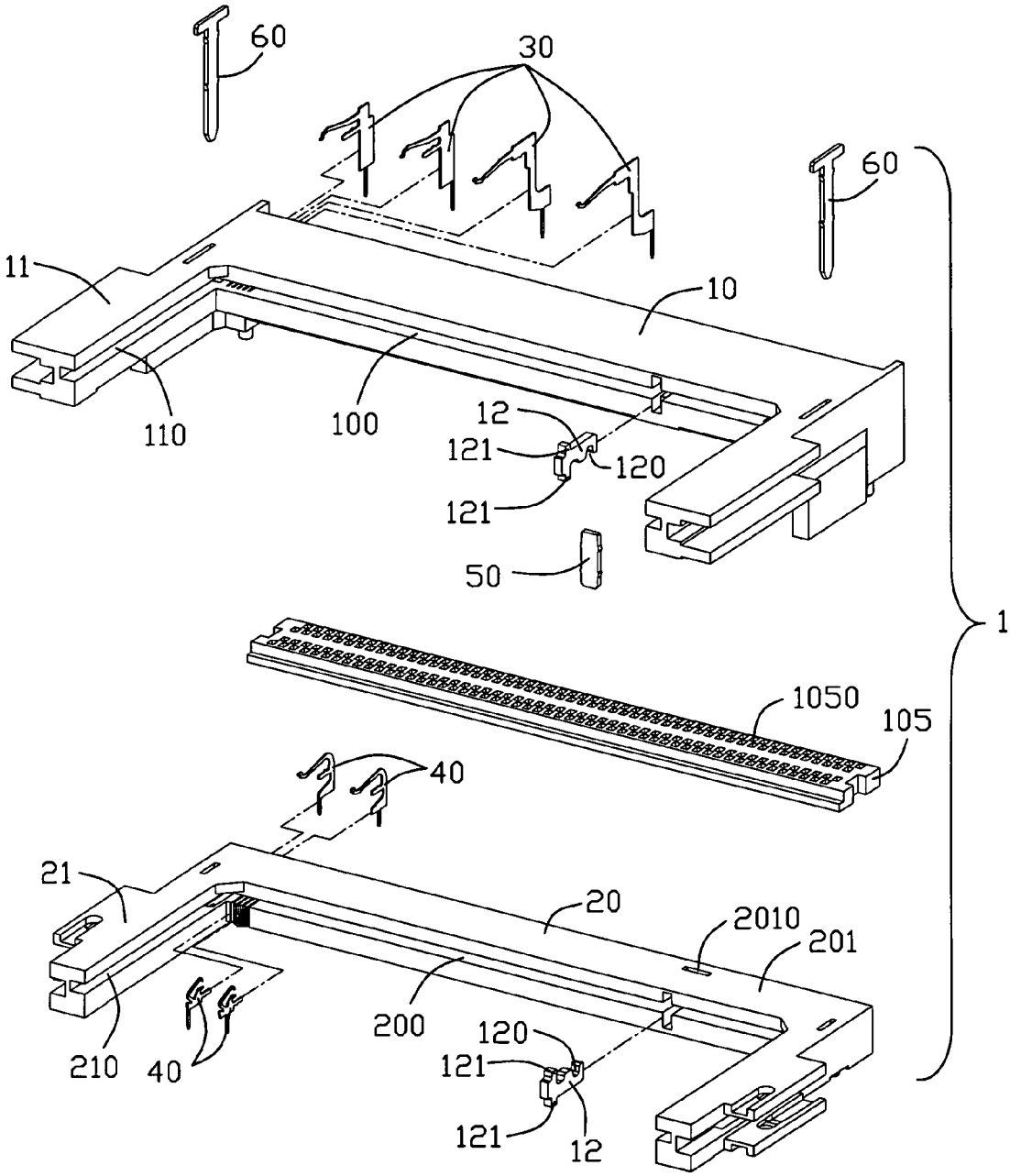
FIG. 3 is an exploded, perspective view of the electrical connector assembly according to the embodiment of the present invention.
Figure 4:
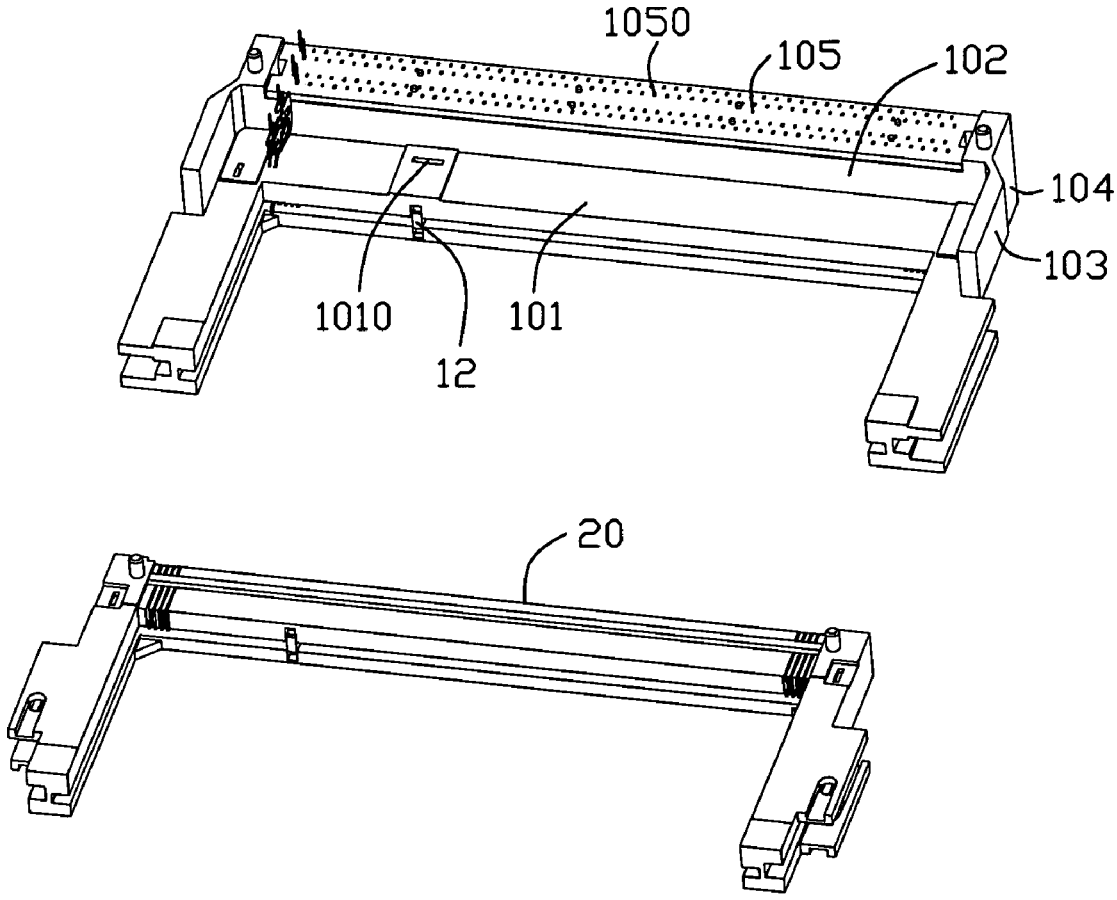
FIG. 4 is another exploded, perspective view of the electrical connector assembly according to the embodiment of the present invention.
Figure 5:
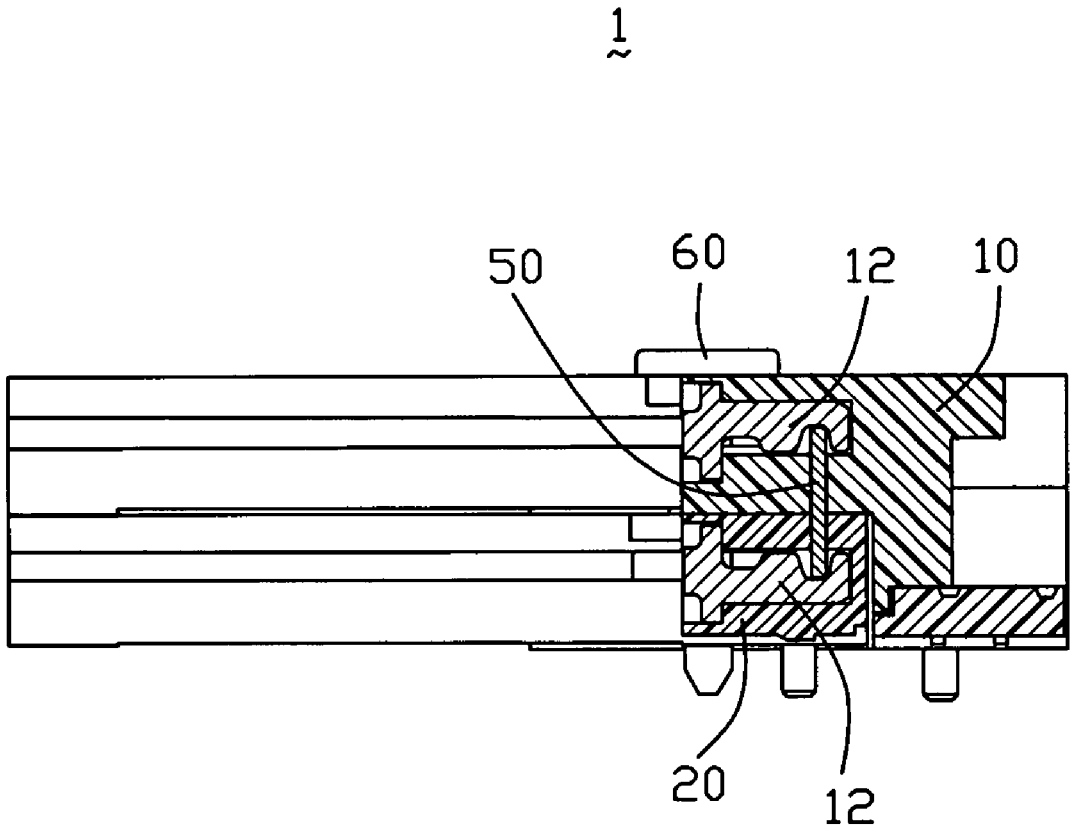
FIG. 5 is a cross-section view taken along a line 5-5 in FIG. 1.

Referring to FIG. 3 to FIG. 5, the metal peg 50 is punched from a metal plate and is positioned adjacent to the first key element 12 and the second key element 12, with each of two ends respectively inserted within the first insulative housing 10 and the second insulative housing 20 which thus be interconnected with each other. Each of the key elements 12 has a gap 120 engaging with the metal peg 50 and a pair of protuberances 121 respectively extending from opposing edges of the key element 12 and interfering with the insulative housing 10, 20 for ensuring the key element 12 to be retained firmly within the elongated slot 100, 200. The two opposing ends of the metal peg 50 inserted in the openings 1010, 2010 respectively engages with the gap 120 of key elements 12.

An inserting force generates and is mainly exerted on the first insulative housing 10 when the upper memory card is being inserted into the first elongated slot 100. Since the first insulative housing 10 and second insulative housing 20 are interconnected together by the metal peg 50, the integral intensity of the electrical connector assembly 1 is enhanced, and the force exerted on the first insulative housing 10 is partially displaced into the second insulative housing 20, and thus the soldering relation between the first terminals 30 and the PCB is effectively prevented from being broken. In the other hand, the electrical connector assembly 1 is prevented from being broken especially in the case of a big inserting force generating from the upper memory card.

Figure 2:
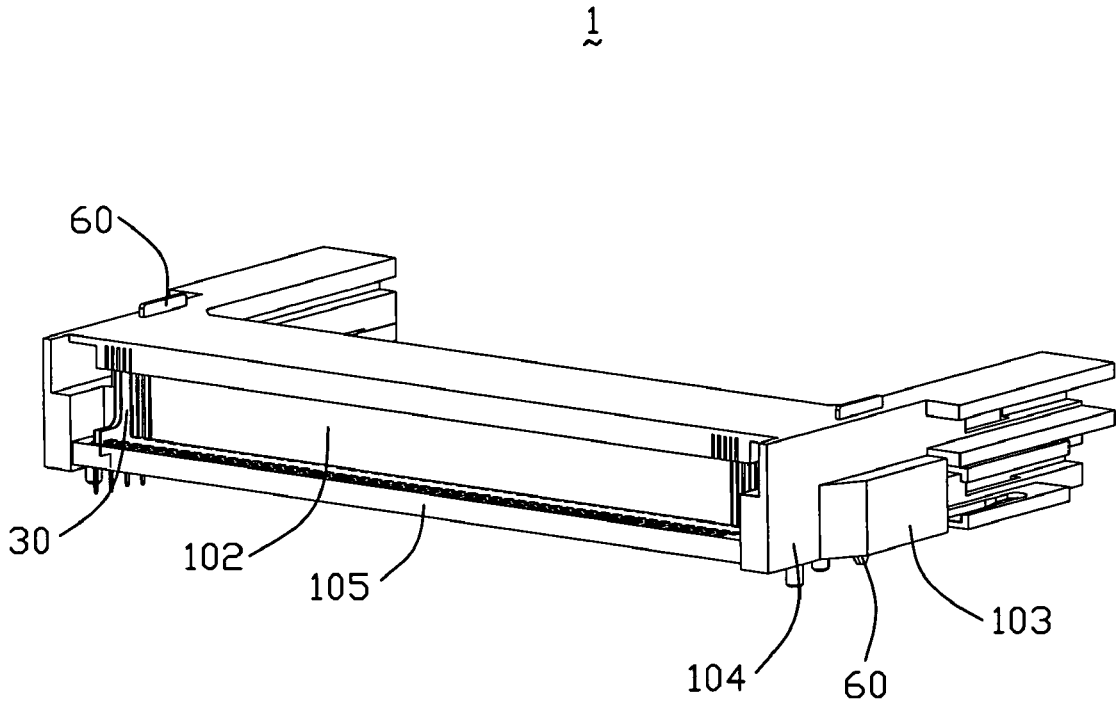
FIG. 2 is another assembled, perspective view of the electrical connector assembly according to the embodiment of the present invention.

Referring to FIG. 2 to FIG. 3, a pair of metal nails 60 are provided to further enhance the integral intensity of electrical connector assembly 1, especially to prevent the relative rotation between the first insulative housing 10 and the second housing 20 in a horizontal plane. The pair of metal nails 60 are respectively inserted to the electrical connector assembly 1 at two ends thereof from an up-to-bottom direction, with their tip ends through the two stacked insulative housings one by one and than soldered on the PCB.

Apparently, different from the above description of the preferred embodiment, the key element, metal peg and metal nail can be made from other material instead of metal material.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly comprising:

a first insulative housing having a first elongated slot with a first key element therein, a plurality of first terminals being received in the first insulative housing; for connecting to a first memory card therein a second insulative housing positioned below said first insulative housing and having a second elongated slot with a second key element therein, a plurality of second terminals being received in the second insulative housing; for connecting a second memory card therein; and a metal peg positioned adjacent to said first key element and said second key element and having ends respectively inserted into said first insulative housing and said second insulative housing wherein said first insulative housing has a bottom surface with an opening therein and said second insulative housing has a top surface with another opening therein, said ends of the peg being respectively inserted into said openings;

wherein said openings respectively communicates with said first elongated slot and said second elongated slot, each of said first key element and said second key element having a gap engaging with one of the ends of said metal peg;

wherein a pair of metal nails are inserted to the electrical connector assembly at two ends thereof from an up-to-bottom direction, with their tip ends through the first insulative housing and the second insulative housing one by one.

2. The electrical connector assembly according to claim 1, wherein said first key element and the second key element are better than said first insulative housing and said second insulative housing in resistibility of abrasion or breakage.

3. The electrical connector assembly according to claim 2, wherein at least one of said first key element and second key element has at least one protuberance interfering with corresponding at least one of the first insulative housing and the second insulative housing.

4. The electrical connector assembly according to claim 3, wherein each of the first insulative housing and the second insulative housing has a pair of guiding arms extending forwardly from two ends thereof, the guiding arms having guiding slots communicating with said first elongated slot and the second elongated slot.

5. The electrical connector assembly according to claim 1, wherein said first insulative housing has a rear wall extending downwardly from the bottom surface and side walls extending forwardly from two ends of the rear wall, said rear wall and the side walls together defining a receiving space for receiving the second insulative housing.

6. The electrical connector assembly according to claim 5, wherein a terminal-positioning plate is mounted below the first insulative housing with a plurality of through holes therein allowing the first terminals to pass through.

7. An electrical connector assembly comprising:

a first insulative housing having a first elongated slot with a first key element retained therein, a plurality of first terminals being received in the first insulative housing; for connecting to a first memory card therein a second insulative housing positioned below said first insulative housing and having a second elongated slot with a second key element retained therein, a plurality of second terminals being received in the second insulative housing for connecting a second memory card therein; and a metal peg engaging with the first key element and the second key element, said first insulative housing and the second insulative housing being interconnected with each other;

wherein each of the first insulative housing and the second insulative housing has an opening communicating with the first and the second elongated slots respectively for insertion of the metal peg;

wherein each of the first key element and the second key element has a gap engaging with the metal peg;

wherein a pair of metal nails are inserted to the electrical connector assembly at two ends thereof from an up-to-bottom direction, with their tip ends through the first insulative housing and the second insulative housing one by one.

8. The electrical connector assembly according to claim 7, wherein at least one of said first key element and second key element has at least one protuberance interfering with corresponding at least one of the first insulative housing and the second insulative housing.

9. The electrical connector assembly according to claim 8, wherein each of the first insulative housing and the second insulative housing has a pair of guiding arms extending forwardly from two ends thereof, the guiding arms having guiding slots communicating with said first elongated slot and the second elongated slot.

10. The electrical connector assembly according to claim 7, wherein a terminal-positioning plate is mounted below the first insulative housing with a plurality of through holes therein allowing the first terminals to pass through.

11. An electrical connector assembly comprising:

a first connector including a first insulative housing having a first central slot with a plurality of first contacts by two sides thereof wherein said first central slot is dimension to allow a corresponding first module to be inserted in only a front-to-back direction, said first connector further including a discrete first key inserted into the first central slot for compliantly receiving a corresponding notch of the first module when said first module is inserted into the first central slot;

a second connector stacked upon the first connector and including a second insulative housing having a second central slot with a plurality of second contacts by two sides thereof wherein said second central slot is dimensioned to allow a corresponding second module to be inserted in only said front-to-back direction; wherein a metal peg extends through an interface between said first and second housings and into said first and second housings to interlock with said first key and a portion of the second housing for preventing relative movement of the said first and second housings in said front-to-back direction;

wherein said second connector further includes a discrete second key inserted into the second central slot for compliantly receiving a corresponding notch of the second module when said module is inserted into the second central slot;

wherein said metal peg further interlocks with the second key;

wherein a pair of metal nails are inserted to the electrical connector assembly at two ends thereof from an up-to-bottom direction, with their tip ends through the first insulative housing and the second insulative housing one by one.

* * * * *